US007654331B2

(12) United States Patent
Wolters

(10) Patent No.: US 7,654,331 B2
(45) Date of Patent: Feb. 2, 2010

(54) METHOD AND APPARATUS FOR REDUCTION OF CONTROL LINES TO OPERATE A MULTI-ZONE COMPLETION

(75) Inventor: Sebastiaan Wolters, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 271 days.

(21) Appl. No.: 11/352,675

(22) Filed: Feb. 13, 2006

(65) Prior Publication Data

US 2007/0187106 A1 Aug. 16, 2007

(51) Int. Cl.
*E21B 34/10* (2006.01)

(52) U.S. Cl. ..... 166/375; 166/72; 166/319

(58) Field of Classification Search ..... 166/374, 166/375, 72, 319; 137/624.18
See application file for complete search history.

(56) References Cited

U.S. PATENT DOCUMENTS

2004/0050555 A1* 3/2004 Rayssiguier et al. ..... 166/374

OTHER PUBLICATIONS

Weatherford International Ltd., "Weatherford Installs Its First four Zone Simply Intelligent (TM); Next Milestone in Continued commercialization of Hydroptic (TM) Technology", www.weatherford.com, News Releases, Feb. 24, 2003, Houston, TX, pp. 1-2.

Welldynamics "WellDynamics Contracted for Brunei Installations", www.rigzone.com, Jul. 23, 2003. p. 1-1.

Ole Henrik Lie, Wayne Wallace, "Intelligent Recompletion Eliminates the Need for Additional Well", Presentation at 2000 IADC/SPE Drilling conference, IADC/SPE 59210, New Orleans, Louisiana, Feb. 23-25, 2000, IADC/SPE, pp. 1-16.

* cited by examiner

*Primary Examiner*—Giovanna C Wright
(74) *Attorney, Agent, or Firm*—Cantor Colburn LLP

(57) ABSTRACT

A control system for a plurality of devices including a plurality of devices in at least one group. A first control line is in operable communication with the plurality of devices. A second control line in operable communication with the at least one group. A step-advance mechanism is in operable communication with each of the plurality of the devices, each mechanism being distinct from each other mechanism within the group of devices. Further disclosed herein is a method for reducing the number of control lines needed to control a plurality of downhole devices including supplying a first control line in operable communication with a plurality of devices including at least one group of devices and supplying a second control line in operable communication with the at least one group.

14 Claims, 5 Drawing Sheets

9-Zone Configuration

METHOD AND APPARATUS FOR REDUCTION OF CONTROL LINES TO OPERATE A MULTI-ZONE COMPLETION

BACKGROUND

In the field of hydrocarbon exploration and recovery, holes (wellbores, boreholes) are drilled deep into the crust of the earth to access deposits of fluid hydrocarbons. The degree of fluidity and the makeup of deposits varies, it is desirable to have the ability to control flow from different deposits into the wellbore. Flow control devices are varied in nature and in their particular construction but all must be actuatable from a remote location, such as a surface location, to be of use to a well operator. One common configuration for remote actuation of a downhole device such as a flow control device is a pair of hydraulic control lines. One of the lines is employed to force the flow control device to an open position while the other is employed to force the device to a closed position. While such systems work well for their intended purpose, it is axiomatic that a number of flow control devices each having a pair of hydraulic control lines is problematic with respect to the number of control lines that would ultimately need to reach the location intended for remote control (e.g. surface). All such control lines would need to extend through a borehole that in most instances is 9⅝ inches in diameter. Large numbers of control lines in such a small diameter borehole take up space where space is at a premium. This is not an advantageous situation.

While the art has proposed several remedies for this issue, each is complex, adds cost, adds potential for malfunction and is overall not a panacea. The art is therefore still in need of a configuration and operative modality for flow control valves that reduces the number of necessary hydraulic control lines while maximizing the number of devices controllable thereby and while maintaining simplicity and cost efficiency of design.

SUMMARY

Disclosed herein is a control system for a plurality of devices including a plurality of devices in at least one group. A first control line is in operable communication with the plurality of devices. A second control line in operable communication with the at least one group. A step-advance mechanism is in operable communication with each of the plurality of the devices, each mechanism being distinct from each other mechanism within the group of devices.

Further disclosed herein is a method for reducing the number of control lines needed to control a plurality of downhole devices including supplying a first control line in operable communication with a plurality of devices, the plurality of devices including at least one group of devices and supplying a second control line in operable communication with the at least one group. The method further includes moving the at least one group of devices to a selected position with a step-advance mechanism.

Further disclosed herein is a method for controlling a plurality of devices with two control lines including configuring each device with a distinct step-advance mechanism and alternating pressurization in the control lines to sequentially position the three devices so that following fourteen steps, all possible configurations of the devices have been achieved.

Yet further disclosed herein is a system controlling nine devices with four control lines. The system includes a first control line in operable communication with all nine devices, a second control line in operable communication with a group of three of the devices, a third control line in operable communication with a second group of three of the devices, a fourth control line in operable communication with a third group of three of the devices and each of the nine devices having a step-advance mechanism, and wherein the step-advance mechanisms are distinct within groups.

Yet further disclosed herein is a method for independently controlling a plurality of groups of devices including supplying a number of control lines equal to the number of groups of devices plus 1 control line.

Yet further disclosed herein is a system for controlling a plurality of devices with a reduced number of control lines. The system includes a plurality of devices represented by one or more groups of devices, a number of control lines equal to the number of groups of devices plus one control line.

BRIEF DESCRIPTION OF THE DRAWINGS

Referring now to the drawings wherein like elements are numbered alike in the several Figures.

DETAILED DESCRIPTION

Figure 1:
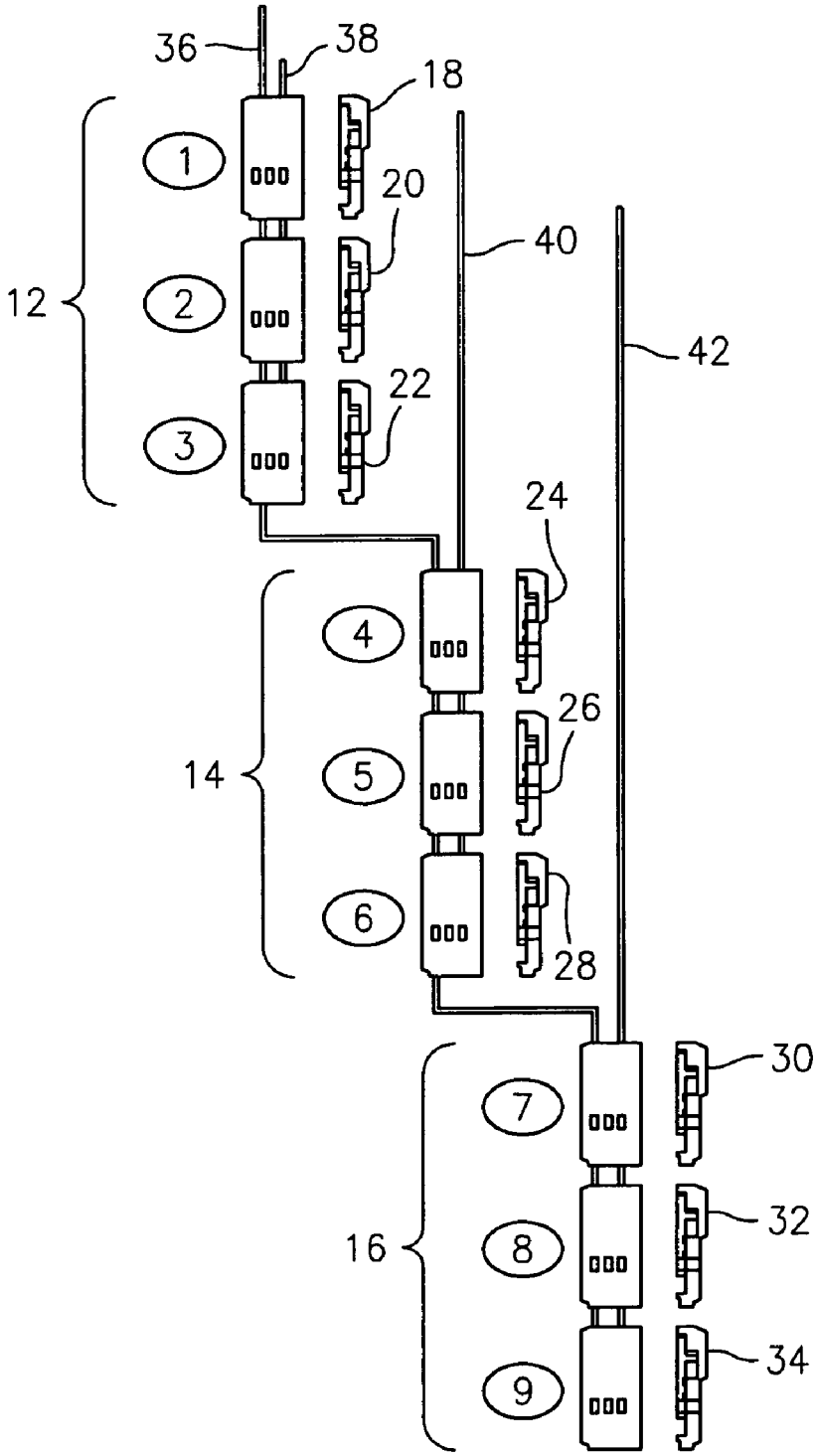
FIG. 1 is a schematic illustration of a flow control valve actuation configuration utilizing four control lines and actuating nine flow control devices.

Referring to FIG. 1, a system is illustrated that provides for remote control of nine individual flow control devices using only four hydraulic control lines. The configuration and operational functionality is facilitated by grouping of flow control devices and through the incorporation of a step-advance mechanism, which may comprise a J-slot and optionally a bearing sleeve in each flow control device. The illustrations and most of this specification are directed to a three device per group arrangement. It is to be understood however that groups of two devices or four devices are also possible and contemplated as within the scope of the invention. In the specifically illustrated embodiment(s) groupings of flow control devices include groups 12, 14 and 16. Each group includes three flow control devices 18, 20, 22; 24, 26, 28; and 30, 32, 34, each device having two positions, those being closed and open, open and choked or choked and closed. This provides a total number of distinct configurations of two to the third power or eight ($2^3=8$). This is represented for clarity in the following table:

| | Position | | | | | | | |
|---|---|---|---|---|---|---|---|---|
| Sleeves | 1 | 2 | 3 | 4 | 5 | 6 | 7 | 8 |
| 1 | O | C | O | C | O | C | O | C |
| 2 | O | O | C | C | O | O | C | C |
| 3 | O | O | O | O | C | C | C | C |

Where O = Open and
C = Closed

Two hydraulic control lines are employed for each group of devices 12, 14 and 16 as one line is required to actuate the devices to the home position and one line is required to actuate the devices to the second position. For group 12, these lines are line 36 and line 38. The reader will note that line 38 is a home line (home position for purposes of this disclosure is the open position of the devices; it will be appreciated however that home could be any predetermined position to which the device will return when actuated in one direction). Home line 38 is shared by all devices in groups 12, 14 and 16 as illustrated. When line 38 is pressured-up then, all devices of group 12 are actuated and move to the home position. Line 38 and individual lines for groups 14 and 16, i.e., lines 40 and 42 are not shared between groups but are shared among devices within each group. More specifically, line 38 is shared among devices 18, 20 and 22; line 40 is shared among devices 24, 26 and 28; and line 42 is shared among devices 30, 32 and 34. Each of lines 38, 40 and 42 are "home" actuating lines. Line 36 is common to all devices and actuates to the second (open, choked or closed) position. Each of lines 38, 40 and 42 independently actuate only the single group with which they are associated.

At this point it is clear that all devices can be moved to the position by line 36 pressure. It is also clear that group 12 devices may all be actuated to the home position by line 38; group 14 devices may all be actuated to the home position by line 40; and group 16 devices may all be actuated to the home position by line 42.

If it would be sufficient for a particular application to have each device of each group of devices in the same position (i.e., either open or closed; open or choked; closed or choked), then the system so far described is useful in that nine devices are operable by four control lines.

Since it is not often sufficient in the downhole environment to have a group of devices, for example devices 18, 20 and 22, all open or all closed or all choked, but rather is often the case that they would be in different positions, further capability in the groups is desirable. To provide the greater variability of positioning among individual devices of each group of devices 12, 14 or 16, each device 18, 20, 22, 24, 26, 28, 30, 32 and 34 is constructed with a step-advance mechanism comprising such as a J-slot and optionally a bearing sleeve.

Figure 2:
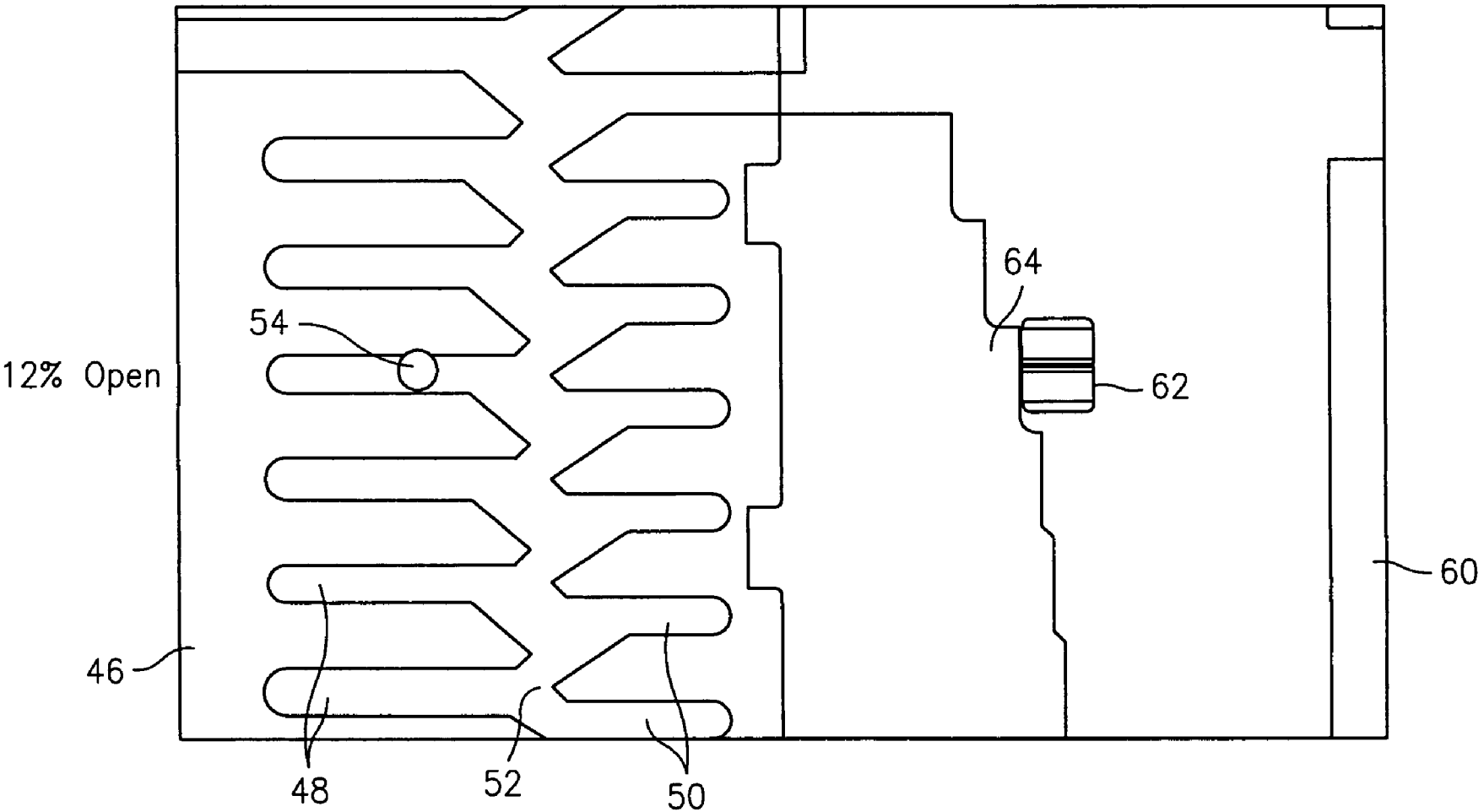
FIG. 2 is a representative schematic view of a J-slot and bearing sleeve laid flat.

Referring to FIG. 2, a J-slot sleeve 46 has been illustrated cut and laid flat for clarity. One of ordinary skill in the art is familiar with J-slot sleeves, their purpose being to guide a pin during reciprocal movement into advancing slots. In the illustration, a number of slot sections 48 and slot sections 50 are shown. The "J-sections" 52 between each slot section pair 48/50 are configured to allow a pin 54 to advance in the J-slot sleeve 46 in only one direction. It will be noted that each slot section 48 is the same length in the figure and each slot section 50 is the same length in the figure. In such configuration, there is no specifically controlled movement of the attached device. It is possible in this invention to use J-slots having different slot section lengths to specifically control movement but this relies on the load holding capability of the pin 54. In higher load situations, which are anticipated for the devices hereof, a bearing sleeve 60 is employed along with the J-slot sleeve 46, together making up the step-advance mechanism. The purpose of the bearing sleeve 60 is to create a specific control of motion of the attached device and hold the load thereof. Thus bearing lug 62 is appreciably larger in dimension, and therefore strength, than pin 54. The bearing sleeve 60 is of a stepped configuration allowing for specific position limiting of the bearing lug 62.

In this disclosure, an object is to operate multiple flow control devices with few control lines. In the illustrations, which follow, the individual flow control devices utilize only two positions: open and closed, closed and choked or choked and open. The FIG. 2 illustration allows for more variability than that illustrated in the balance of the drawings hereof. Upon exposure to more of this disclosure one skilled in the art will appreciate that more variables could be introduced to the concept hereof by lengthening the circumferential step-advance mechanism path. This is done for example by adding more J-steps (each comprised of slot section 48/50 and J-section 52) to the sleeve. In such a system, it is possible to add more variability regarding positioning and still allow for sufficient stepping to account for all combinations of possible positions. More or fewer J-slot steps is also relevant to groups of devices containing more of fewer devices. For example, other groups of devices are contemplated herein and include for example two or four devices. In a two device group, the step-advance mechanism would have four total positions yielding four steps of the device (three home positions and three second positions). In a four device group the step-advance mechanism would have thirty positions to account for all combinations of device positions. Alternatively, one or more of the devices could have no step-advance mechanism at all while others in the same group would have a step-advance mechanism. By so configuring the system, more devices are available without requiring an unwieldy number of step-advance mechanism positions. It is to be understood that the number of devices operable by the concept hereof is limited only by the number of control lines allowed. Twenty one devices or more can be controlled, for example. Essentially, the concept hereof is mathematically described as number of control lines equal (number of devices/number of devices per group plus 1).

FIG. 2 illustrates bearing lug 62 in a position away from home (or open) and stopped from further motion by stop 64 of bearing sleeve 60. A stop such as this is illustrated more schematically in FIGS. 3-5 and is referred to here for the clarity offered by the more detailed drawing. As noted above, the FIG. 2 bearing sleeve provides for variable actuation of a single sleeve. This must be taken into account when considering the following figures and disclosure. Providing this variability in a control line reducing system as set forth herein increases complexity and would require significantly more J-steps to represent each possible interaction. While possible, the number of system pressure-up steps will at some point become unwieldy and outweigh the benefit-ratio of the concept.

Figure 3:
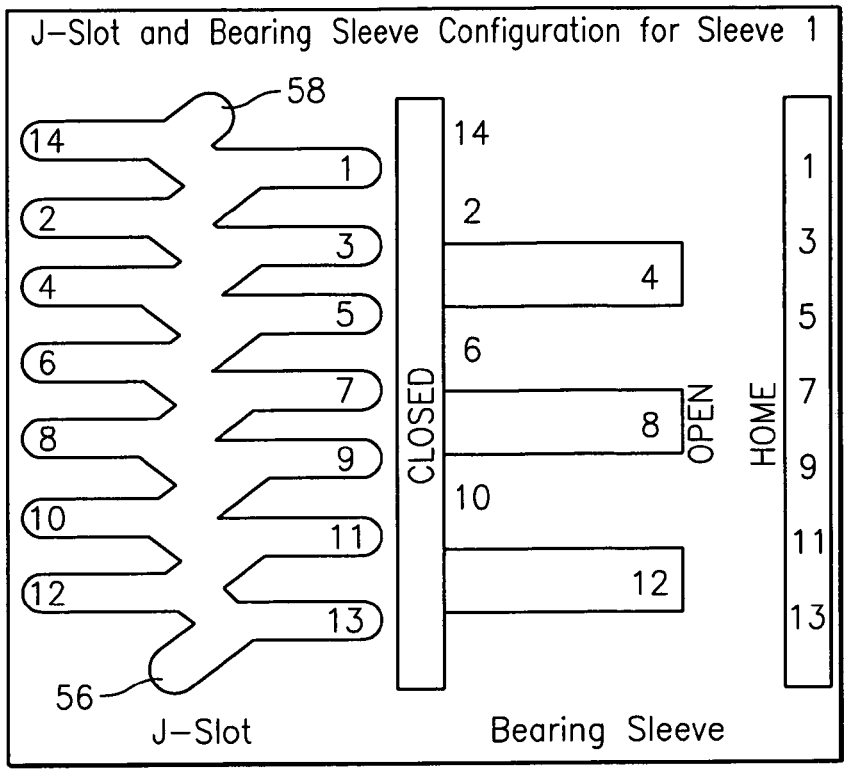
FIG. 3 is a schematic view of a J-slot and bearing sleeve arrangement for a first control device in a group.
Figure 4:
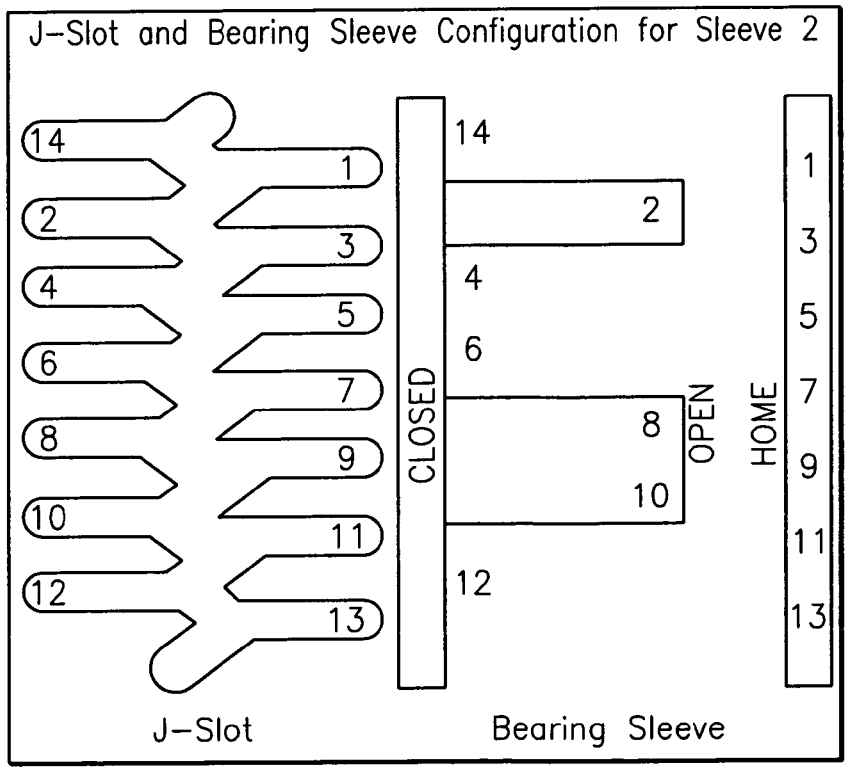
FIG. 4 is a schematic view of a J-slot and bearing sleeve arrangement for a second control device in a group.
Figure 5:
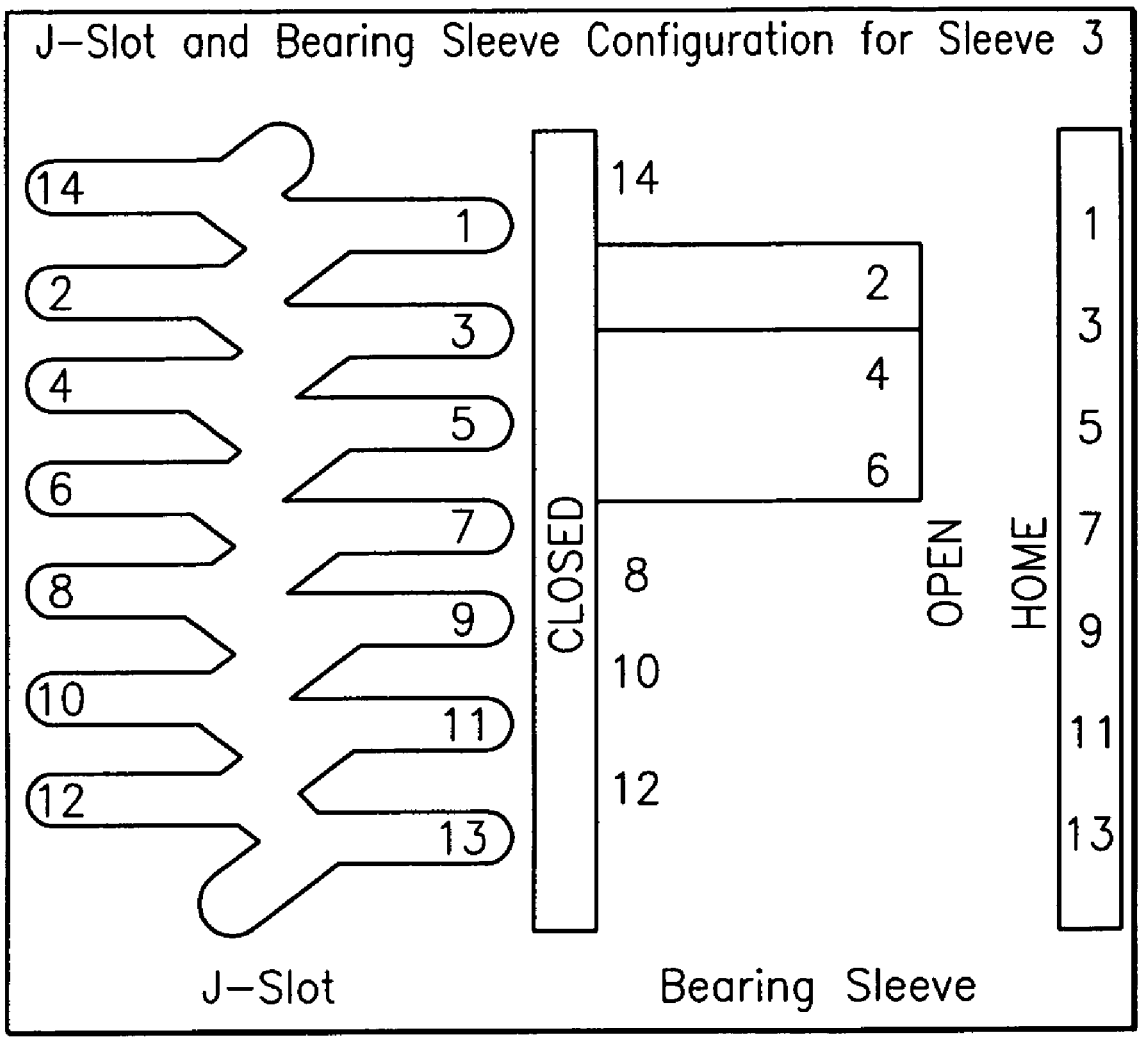
FIG. 5 is a schematic view of a J-slot and bearing sleeve arrangement for a third control device in a group.

Referring to FIGS. 3-5, schematic illustrations of the J-slot sleeve and bearing sleeve are shown. FIG. 3 relates to device 18 for a one group system; devices 18 and 24 for a two group system; and devices 18, 24 and 30 for a three group system. FIG. 4 relates similarly to device 20; to devices 20 and 26; or to devices 20, 26 and 32. FIG. 5 relates to device 22; to devices 22 and 28; or to devices 22, 28 and 34. As is now apparent, each device of a group of devices is constructed with a unique bearing sleeve. Because of this, pressuring up on control line 36 may have differing actuation of the three devices in each group. Moving through the various positions of the J-slot sleeve, each group of three devices can be moved through every possible combination of positions.

Still referring to FIGS. 3-5, the J-slot sleeve representation is of a continuous J-slot with end 56 adjoining end 58 when in tubular configuration. As stated above, the J-slot sleeve portion of this arrangement operates to advance the pin 54 shown in FIG. 2 thereby also advancing the bearing lug 62 shown in FIG. 2. In FIG. 3 one should appreciate that bearing lug 62 (shown in FIG. 2) cannot move leftwardly in the figure at position 12, 8 and 4 but can so move at position 10, 6, 2 and 14, with position 13, 11, 9, 7, 5, 3 and 1 being rightwardly of the figure and unimpeded. These latter positions are the home positions, have in this example being open. The operation of the J-slot and bearing sleeves in FIG. 3 is the same in FIGS. 4 and 5 with stops at distinct positions. The stops in FIG. 4 are at positions 10, 8 and 2 and for FIG. 5 at positions 6, 4 and 2. In each case the stops prevent closure of the associated device when pressure is exerted on line 36 while allowing such closure when stops are not positioned.

In each of the J-slot configurations, fourteen positions are shown. This comports with the two positions to the third power statement made earlier as each valve is stepped back and forth between a home position and a second position. This means that the valves are at the home condition at positions 1, 3, 5, 7, 9, 11 and 13 and at second positions, which are dictated by the stops of FIGS. 3-5 for positions, 2, 4, 6, 8, 10, 12 and 14. One will appreciate this and its cyclic implications for combinations of device position in the table below:

| | Positions | | | | | | | | | | | | | |
|---|---|---|---|---|---|---|---|---|---|---|---|---|---|---|
| Sleeves | 1 | 2 | 3 | 4 | 5 | 6 | 7 | 8 | 9 | 10 | 11 | 12 | 13 | 14 |
| 1, 4&7 | H | C | H | O | H | C | H | O | H | C | H | O | H | C |
| 2, 5&8 | H | O | H | C | H | C | H | O | H | O | H | C | H | C |
| 3, 6&9 | H | O | H | O | H | O | H | C | H | C | H | C | H | C |

Positions:
H = Home Position (= Open),
C = Closed,
O = Open

Figure 6:
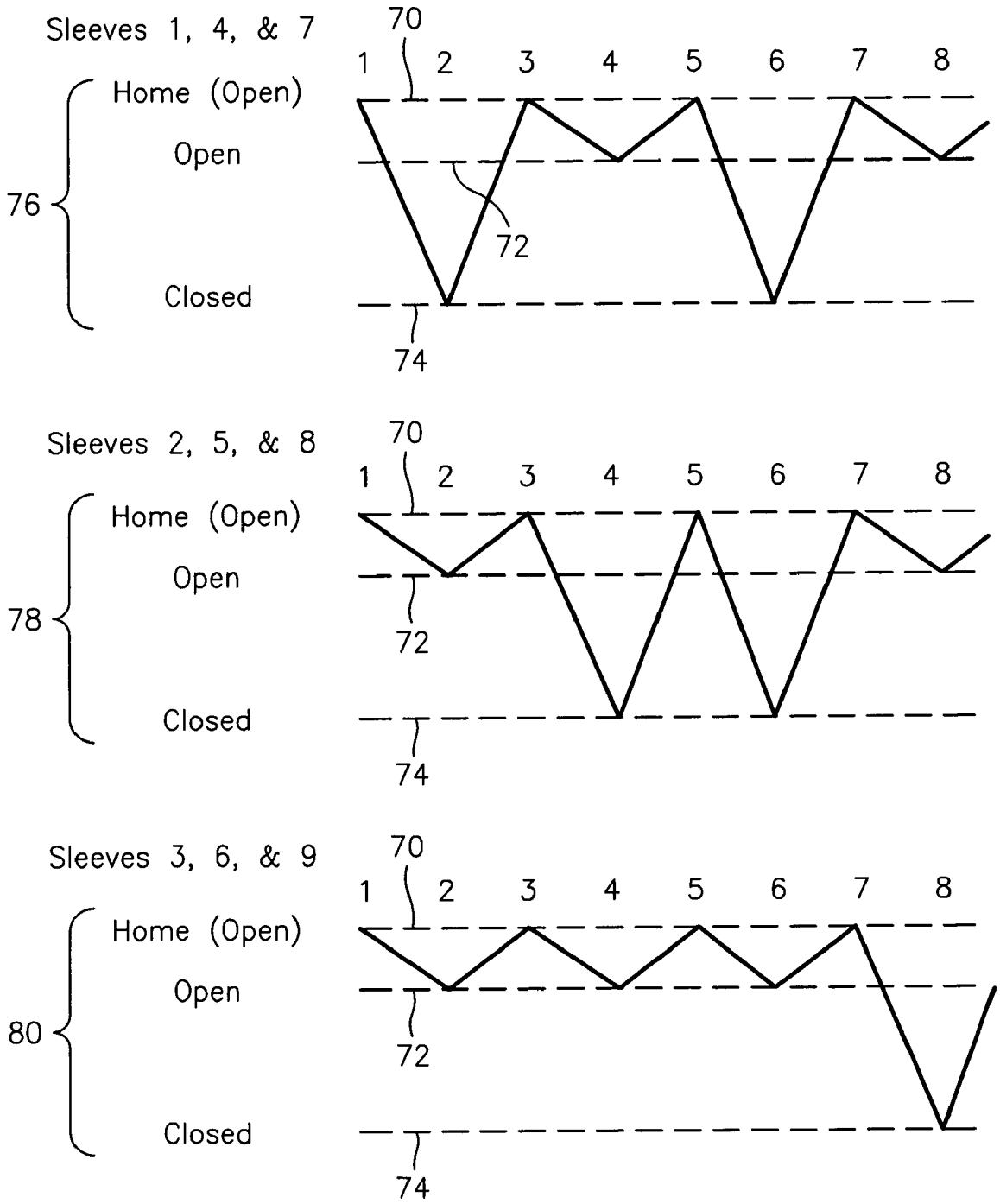
FIG. 6 is a representation of the collective movements of the flow control devices in a nine valve on four line setup.

Referring to FIG. 6, the foregoing tabular operation is illustrated more graphically. A nine valve (device) system is illustrated however it should be understood that this same figure could represent a three or six device configuration identically. The graphical representations each include three broken lines 70, 72 and 74. Line 70 represents the home position; line 72 the stopped position and line 74 the closed position. The three graphical representations are specifically aligned from top to bottom to provide an indication of the distinctions of actuation among the three devices in each group. These three graphical representations also relate directly to FIGS. 3-5. The top most graphical representation 76 relates to FIG. 3; the representation 78 to FIG. 4 and the representation 80 to FIG. 5.

By stepping through all fourteen positions of the illustrated embodiments, each possible combination of binary movement for the three valves in each group is achievable and this control for flow in the well is achieved for three valves with only two control lines; for six valves with only three control lines and for nine valves with only four control lines. As noted above: number of control lines equals (number of devices divided by number of devices per group) plus 1. The system as described significantly reduces the problem of overcrowding of the wellbore with control lines. Moreover, since this system uses only two positions for each valve, no graduated fluid pressure in the control line is necessary. This facilitates non-surface located hydraulic initiators and therefore additional benefit to the art in the form of reduced well head crowding since the lines need not exit the wellbore at all.

In one embodiment utilizing the above-disclosed concept, a surface control system having predictable and controllable volume and/or pressure capability is provided. This provides for automatic compensation of fluid volumes and/or pressures as the devices age. Furthermore, the control system may be operable remotely. The control system may in one embodiment include a programmable logic system.

While preferred embodiments have been shown and described, modifications and substitutions may be made thereto without departing from the spirit and scope of the invention. Accordingly, it is to be understood that the present invention has been described by way of illustrations and not limitation.

What is claimed is:

1. A control system for a plurality of devices comprising:
a plurality of devices in at least one group;
a first control line in operable communication with said plurality of devices;
a second control line in operable communication with said at least one group; and
a mechanism in operable communication with each of said plurality of said devices, each mechanism being distinct from each other mechanism within said group of devices, each mechanism having a number of positions before repeating equal to the number of cycles of the at least one group necessary to accommodate all permutations of the at least one group of devices, each position occurring in response to a discrete pressure event, each pressure event of substantially the same magnitude within the first control line.

2. A control system for a plurality of devices as claimed in claim 1 wherein each group of devices of said plurality of devices is operable by said first control line.

3. A control system for a plurality of devices as claimed in claim 1 wherein a third control line is in operable communication with a second group of said plurality of devices.

4. A control system for a plurality of devices as claimed in claim 1 wherein a forth control line is in operable communication with a third group of said plurality of devices.

5. A control system for a plurality of devices as claimed in claim 1 wherein a total number of control lines utilized for said plurality of devices is equal to (the total number of devices divided by the total number of devices per group) plus 1.

6. A control system for a plurality of devices as claimed in claim 1 wherein said step-advance mechanism further comprises a bearing sleeve in operable communication with a J-slot of each mechanism, said bearing sleeve providing stops for the associated devices.

7. A control system for a plurality of devices as claimed in claim 6 wherein the bearing sleeve configuration facilitates positions of the associated device of open and closed, closed and choked or choked and open.

8. A control system for a plurality of devices as claimed in claim 1 wherein each group of devices includes three devices.

9. A control system for a plurality of devices as claimed in claim 1 wherein said step-advance mechanism steps said devices between a home position and a second position.

10. A control system for a plurality of devices as claimed in claim 9 wherein said home position is one of open, choked or closed.

11. A control system for a plurality of devices as claimed in claim 10 wherein said second position is one or the other of the positions represented in claim 9 that is not the home position.

12. A control system for a plurality of devices as claimed in claim 1 wherein said system further includes a surface control system.

13. A control system for a plurality of devices comprising:

a plurality of devices in at least one group;

a first control line in operable communication with said plurality of devices;

a second control line in operable communication with said at least one group; and a step-advance mechanism in operable communication with each of said plurality of said devices, each mechanism being distinct from each other mechanism within said group of devices wherein said step-advance mechanism comprises fourteen positions.

14. A method for controlling three devices with two control lines comprising:

configuring each device with a distinct step-advance mechanism; and alternating pressurization in said control lines to sequentially position the three devices so that following fourteen steps, all possible configurations of the devices have been achieved.

* * * * *